US010842289B2

(12) United States Patent
Jewett

(10) Patent No.: US 10,842,289 B2
(45) Date of Patent: Nov. 24, 2020

(54) POCKETED SPRING ASSEMBLY INCLUDING CUSHION PADS

(71) Applicant: L&P Property Management Company, South Gate, CA (US)

(72) Inventor: Jason Jewett, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 366 days.

(21) Appl. No.: 15/897,687

(22) Filed: Feb. 15, 2018

(65) Prior Publication Data

US 2019/0246803 A1 Aug. 15, 2019

(51) Int. Cl.

| | |
|---|---|
| ***A47C 27/05*** | (2006.01) |
| ***A47C 27/07*** | (2006.01) |
| ***A47C 27/06*** | (2006.01) |
| ***A47C 7/35*** | (2006.01) |
| ***A47C 7/18*** | (2006.01) |

(52) U.S. Cl.

CPC ..... *A47C 27/05* (2013.01); *A47C 7/18* (2013.01); *A47C 7/35* (2013.01); *A47C 27/056* (2013.01); *A47C 27/064* (2013.01); *A47C 27/07* (2013.01)

(58) Field of Classification Search

CPC ..... A47C 27/05

USPC ..... 5/720, 716, 655.7, 655.8

See application file for complete search history.

(56) References Cited

U.S. PATENT DOCUMENTS

| | | | | |
|---|---|---|---|---|
| 6,490,744 | B1 * | 12/2002 | Schulz, Jr. ..... | A47C 27/063 5/716 |
| 8,474,078 | B2 | 7/2013 | Mossbeck | |
| 2015/0359349 | A1 | 12/2015 | Eigenmann et al. | |
| 2016/0045034 | A1 | 2/2016 | Hager et al. | |
| 2016/0166076 | A1 | 6/2016 | Mossbeck | |
| 2016/0249744 | A1 * | 9/2016 | Eigenmann ..... | A47C 21/042 5/655.8 |

FOREIGN PATENT DOCUMENTS

| | | |
|---|---|---|
| EP | 2789267 | 10/2014 |

* cited by examiner

*Primary Examiner* — Fredrick C Conley

(74) *Attorney, Agent, or Firm* — Wood Herron & Evans LLP

(57) ABSTRACT

A pocketed spring assembly comprises a plurality of parallel strings of springs, each string joined to at least one adjacent string, each string comprising one piece of fabric folded into first and second opposed plies of fabric. Outer pockets are formed along each string by transverse seams joining the first and second plies. One pocketed spring and at least cushion pad is positioned in each outer pocket. The cushion pad may be individually pocketed. An upper end of each transverse seam may be below an upper surface of the string to partially separate adjacent outer pockets within a string.

20 Claims, 16 Drawing Sheets

POCKETED SPRING ASSEMBLY INCLUDING CUSHION PADS

FIELD OF THE INVENTION

This invention relates generally to bedding and seating products and, more particularly, to pocketed spring assemblies used in bedding and seating products.

BACKGROUND OF THE INVENTION

Mattress spring core construction over the years has been a continuously improving art with advancements in materials and machine technology. A well known form of spring core construction is known as a Marshall spring construction wherein metal coil springs are encapsulated in individual pockets of fabric and formed as elongate or continuous strings of pocketed coil springs. In an earlier form, these strings of coil springs were manufactured by folding an elongate piece of fabric in half lengthwise to form two plies of fabric and stitching transverse and longitudinal seams to join the plies of fabric to define pockets within which the springs were enveloped.

More recently, improvements in spring core constructions have involved the use of fabrics which are thermally or ultrasonically weldable to themselves. By using such welding techniques, these fabrics have been advantageously used to create strings of individually pocketed coil springs wherein transverse and longitudinal welds, instead of stitching, are used to form the pockets encapsulating the springs.

Once strings of pocketed springs are constructed, they may be assembled to form a pocketed spring core or assembly for a mattress, cushion or the like by a variety of methods. For example, multiple or continuous strings may be arranged in a row pattern corresponding to the desired size and shape of a mattress or the like, and adjacent rows of strings may be interconnected by a variety of methods. The result is a unitary assembly of pocketed coil springs serving as a complete spring core assembly.

Conventional pocketed spring cores incorporating pocketed strings of springs have less motion transfer between sleeping partners when compared to traditional helically-laced open coil spring assemblies. Each pocketed coil spring is able to move with greater independence and, therefore provide less influence on adjacent pocketed coil springs than if the coil springs were not inside individual pockets. However, with a traditional pocketed spring mattress, a sheet of foam or other cushioning layer is attached to an upper surface of the pocketed spring assembly. The foam or cushioning sheet or sheets acts like a bridge, such that a load applied to one side of a mattress affects the other side of the mattress, providing an undesirable bridging effect. The present invention eliminates the undesirable bridging effect by encapsulating individual cushion members inside outer pockets of strings of springs.

U.S. Pat. No. 6,490,744 discloses a pocketed spring assembly incorporating strings which have individually pocketed coil springs with cushioning pads inside the pockets. However, due to the individual coil springs being un-pocketed, the coil springs may damage the cushioning pads and/or affect the feel of the pocketed spring assembly due to the coil springs pressing against the cushioning pads. The capability of the individually pocketed springs to act independently from the adjacent pocketed springs in the string of springs may be compromised.

Therefore, there remains a need to combine multiple technologies to improve the feel and motion transfer in a bedding or seating product having a pocketed spring core.

SUMMARY OF THE INVENTION

In one aspect, a bedding or seating product is provided. The product comprises a pocketed spring assembly comprising a plurality of parallel strings of springs, each string joined to at least one adjacent string. Each string comprises a piece of fabric surrounding a plurality of pocketed springs and a plurality of cushion pads, first and second opposed plies of fabric being on opposite sides of the pocketed springs and cushion pads. Outer pockets are formed along the length of the string by a longitudinal seam and transverse seams joining the first and second plies. At least one pocketed spring and at least one cushion pad are in each of the outer pockets. Each cushion pad may be individually pocketed and may be any desired size or shape.

Different coil springs may be located inside the inner pockets. In one embodiment, each of the coil springs has upper and lower end turns and a plurality of central convolutions between the end turns, the convolutions decreasing in diameter and pitch from a middle portion of the spring towards at least one of the end turns. In another embodiment, each of the coil springs has upper and lower end turns and a plurality of central convolutions between the end turns, each of the convolutions being the same diameter. Regardless of the configuration of coil spring, each coil spring is preferably made of one piece of wire of a uniform diameter, but not in all cases.

In some embodiments, an upper end of each transverse seam forming adjacent pockets of the string is below an upper surface of the string of springs to partially separate adjacent outer pockets. In other embodiments, such as double-sided pocketed spring assemblies, each end of each transverse seams has a length less than the height of the of the string to partially separate adjacent outer pockets. In the bedding industry, pocketed spring assemblies having such transverse seams are said to have a "split top" feature. Cushioning materials may be placed on the pocketed spring assembly, and a covering, usually an upholstered covering, encases the pocketed spring assembly and cushioning materials.

The strings may extend longitudinally (from end-to-end) or transversely (from side-to-side). A pocketed spring assembly for use in a bedding or seating product may be posturized into regions or zones of different firmness by incorporating different strings into the pocketed spring assembly.

If the strings extend transversely, the pocketed spring assembly may include a plurality of the strings having the "split top" feature in the transverse seams between adjacent outer pockets and strings lacking the "split top" feature, the strings arranged in a plurality of zones longitudinally spaced apart. For example, the pocketed spring assembly may include three such zones. The three zones may comprise a central zone, a head end zone and a foot end zone. The end zones may comprise strings having the "split top" feature, and the strings comprising central zone may comprise strings lacking the "split top" feature. Alternatively, the end zones may comprise strings lacking the "split top" feature, and the strings comprising central zone may comprise strings with the "split top" feature.

If the strings extend longitudinally, the pocketed spring assembly may include strings having the "split top" feature in the transverse seams between adjacent outer pockets and other strings lacking the "split top" feature, the strings arranged in a plurality of zones transversely spaced apart. For example, the pocketed spring assembly may include two such zones, a "his" side and a "hers" side. The "hers" side or zone may comprise strings of springs having the "split top" feature, and the "his" side or zone can comprise strings of springs lacking the "split top" feature.

In another aspect, a pocketed spring assembly for a bedding or seating product is provided. The pocketed spring assembly comprises a plurality of parallel strings. Each string is joined to at least one adjacent string. Each of the strings comprises a plurality of interconnected outer pockets made from one piece of fabric. Each of the outer pockets contains at least one inner pocketed spring and at least one cushion pad. The piece of fabric is joined to itself along a longitudinal seam and has first and second opposed plies of fabric on opposite sides of the inner pocketed springs. The first and second plies of fabric are joined by transverse seams between adjacent inner pocketed springs.

In some embodiments, each of the transverse seams forming the adjacent outer pockets of the string has one end located below an upper surface of the string to partially separate adjacent outer pockets. In other embodiments, each of the transverse seams forming the adjacent outer pockets of the string has one end located below an upper surface of the string and the other end located above a lower surface of the string. Such a string is considered to have the "split top" feature on both sides of the string.

In another aspect, a string of springs for a pocketed spring assembly for a bedding or seating product is provided. The pocketed spring assembly comprises a plurality of parallel strings of springs. Each string is joined to an adjacent string. Each of the strings comprises a plurality of interconnected outer pockets made from one piece of fabric. Each of the outer pockets contains at least one inner pocketed spring and at least one cushion pad. The piece of fabric is joined to itself along a longitudinal seam and has first and second opposed plies of fabric on opposite sides of the inner pocketed springs. The fabric of the first and second plies is joined by transverse seams which are shorter than the string. Each of the transverse seams forming the adjacent outer pockets of the string has an upper end located below an upper surface of the string to partially separate adjacent outer pockets and enable some of the cushion pads to compress without substantially compressing the cushion pads within other outer pockets of the spring.

One advantage of the present invention is that when a bedding or seating product, such as a mattress, is manufactured, the manufacturer need not place one or more sheets of cushioning material over the pocketed spring assembly prior to the unit being upholstered. The mattress manufacturer may simply place a cover around the pocketed spring assembly without using any sheets of cushioning material.

Another advantage of the present invention is that the inner pocketed coil spring does not press into the cushion pad above/below it when subjected to a load. Because the inner pocketed spring is retained in its own inner pocket independent of the cushion pad or pads, the inner pocketed spring does not exert force on the cushion pad or pads, thereby preserving the designed characteristics of the cushion pad or pads such as firmness, for example. The inner pockets of fabric surrounding the coil springs and/or the fabric surrounding each cushion pad preserves the integrity of the cushion pads and increases the life of the pocketed spring assembly. The result is that the user "feels" more of the cushion pad or pads.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
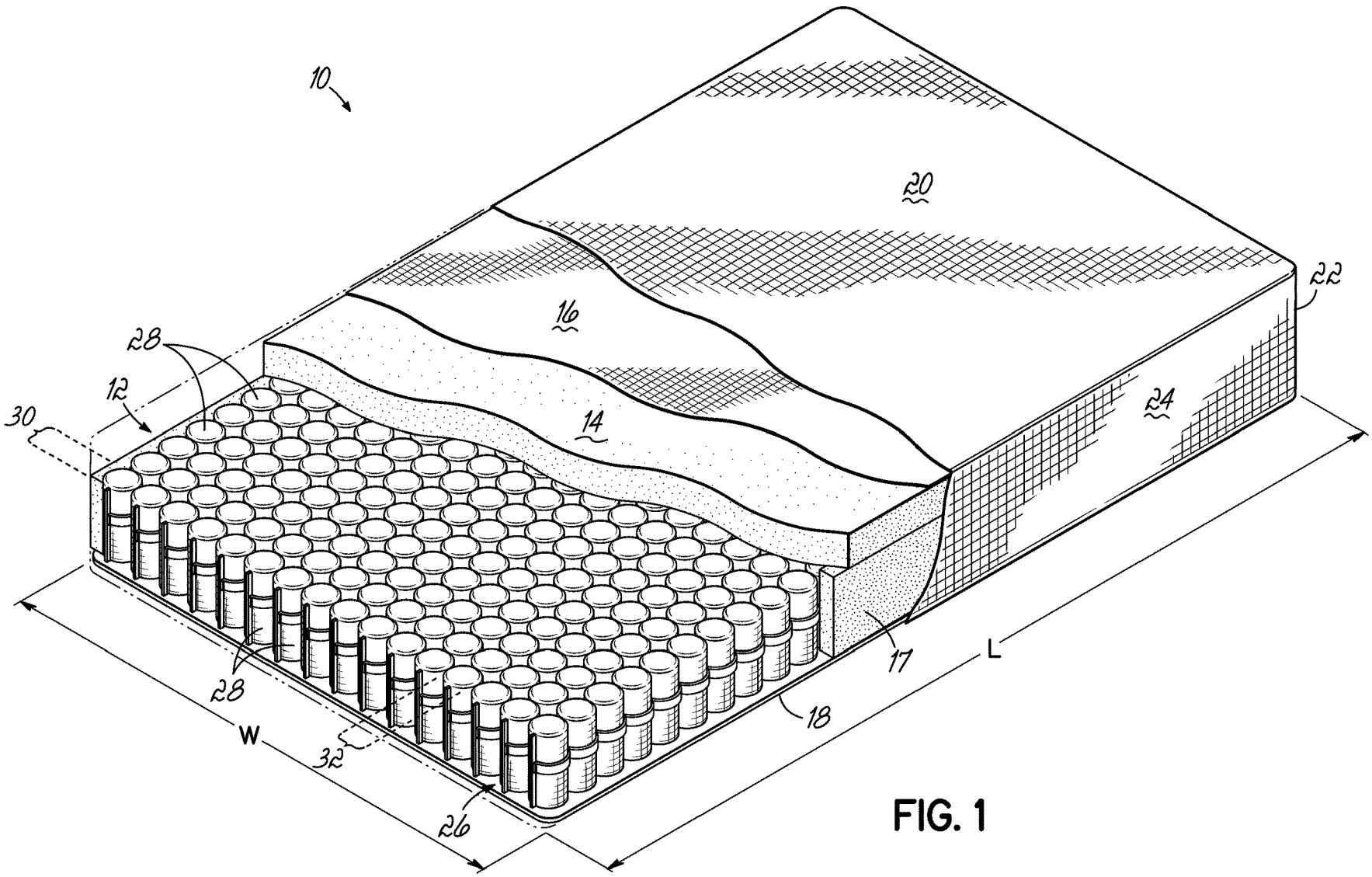
FIG. 1 is a perspective view, partially broken away, of a bedding or seating product incorporating a pocketed spring assembly according to the principles of the present invention.

Referring first to FIG. 1, there is illustrated a bedding product in the form of a single-sided mattress 10 incorporating the principles of the present invention. This product or mattress 10 comprises a pocketed spring assembly 12 over the top of which there lay conventional padding or cushioning layers 14, 16 which may be foam, fiber, gel, a pocketed spring blanket or any other suitable materials or any combination thereof. The pocketed spring assembly 12 is surrounded with a border 17 made of foam or any other suitable material (only a portion being shown in FIG. 1). Although one type of border 17 is illustrated, the border may assume other forms or shapes of any desired size, such as pocketed coil springs. Alternatively, the border 17 may be omitted in this embodiment or any embodiment described or shown herein. This complete assembly is mounted upon a base 18 and is completely enclosed within an upholstered covering material 20. The base and border, regardless of the type of border, are known in the industry as a "bucket" into which a pocketed spring assembly is inserted before the "bucket" is covered with one or more padding or cushioning layers.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

As shown in FIG. 1, pocketed spring assembly 12 is manufactured from multiple strings 26 of pocketed springs 28 joined together. Each string of pocketed springs 26 extends longitudinally or from head-to-foot along the full length of the product 10.

Figure 1A:
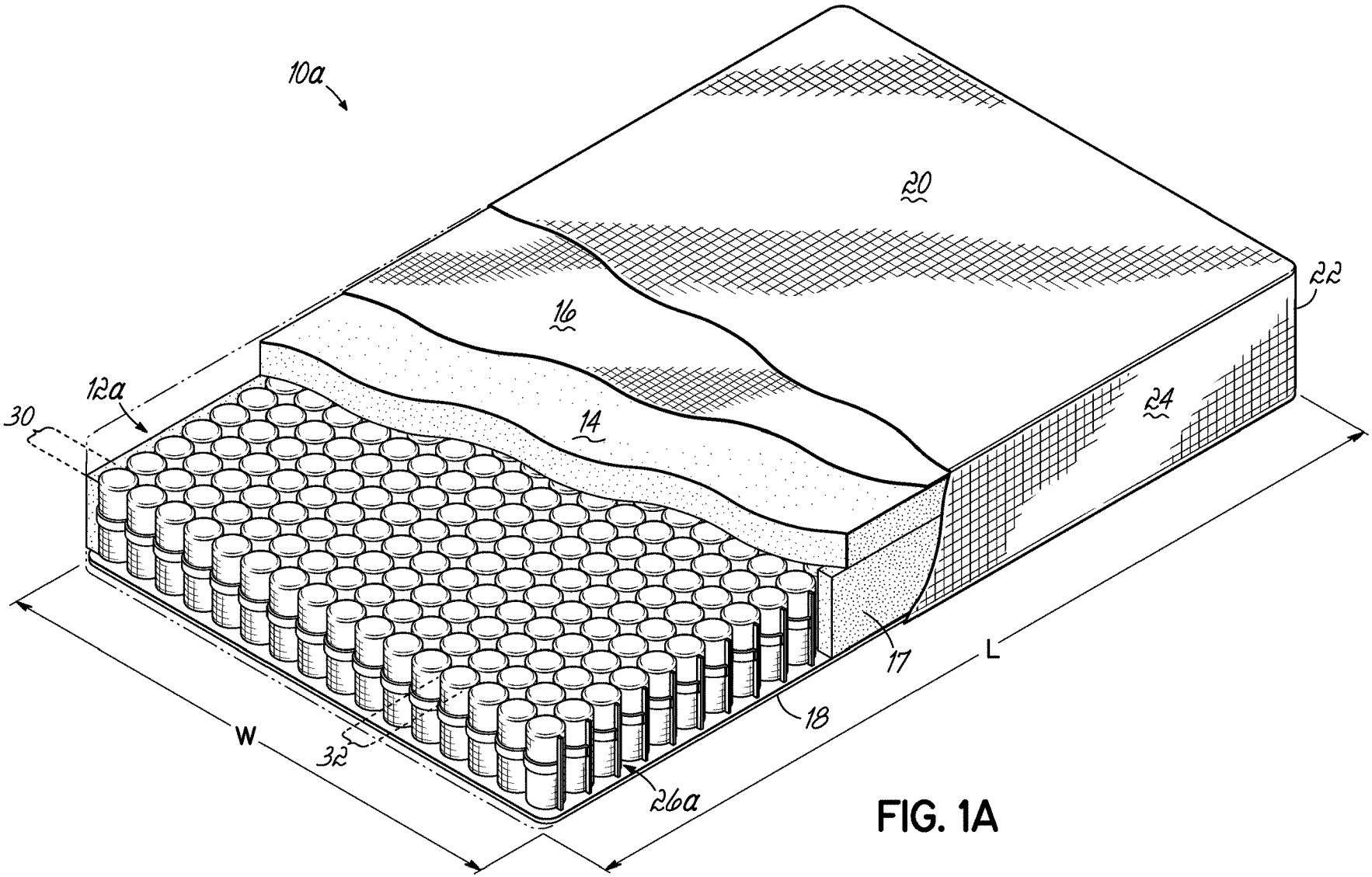
FIG. 1A is a perspective view, partially broken away, of a bedding or seating product incorporating another pocketed spring assembly.

Although the strings of pocketed springs 26 are illustrated as extending longitudinally or from head-to-foot in the pocketed spring assembly 12 of FIG. 1, they may extend transversely or from side-to-side as shown in the pocketed spring assembly 12*a* shown in the product 10*a* shown in FIG. 1A. The pocketed spring assembly 12*a* comprises multiple strings 26*a* of pocketed springs, identical to the strings of springs 26, but shorter in length.

Figure 1B:
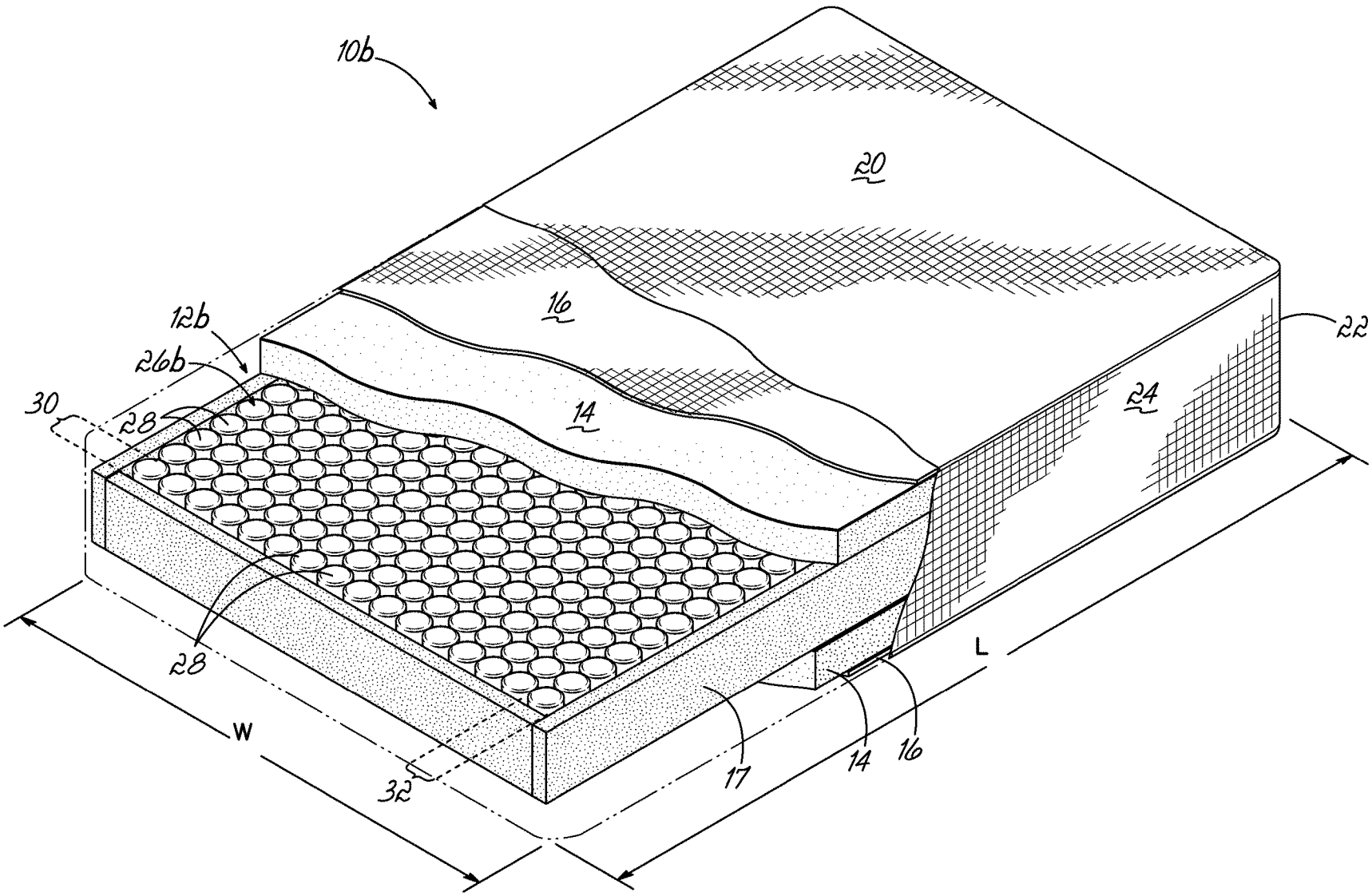
FIG. 1B is a perspective view, partially broken away, of a double-sided bedding product incorporating another pocketed spring assembly.

FIG. 1B illustrates a double-sided mattress 10*b* comprising a pocketed spring assembly 12*b* and border 17 identical to those shown in the mattress 10 of FIG. 1. However, the mattress 10*b* of FIG. 1B has conventional padding layers 14, 16 above and below a double-sided pocketed spring assembly 12*b*. The double-sided pocketed spring assembly 12*b* comprises a plurality of strings 26*b* of pocketed springs, one being partially shown in cross-section in FIG. 7.

Figure 1C:
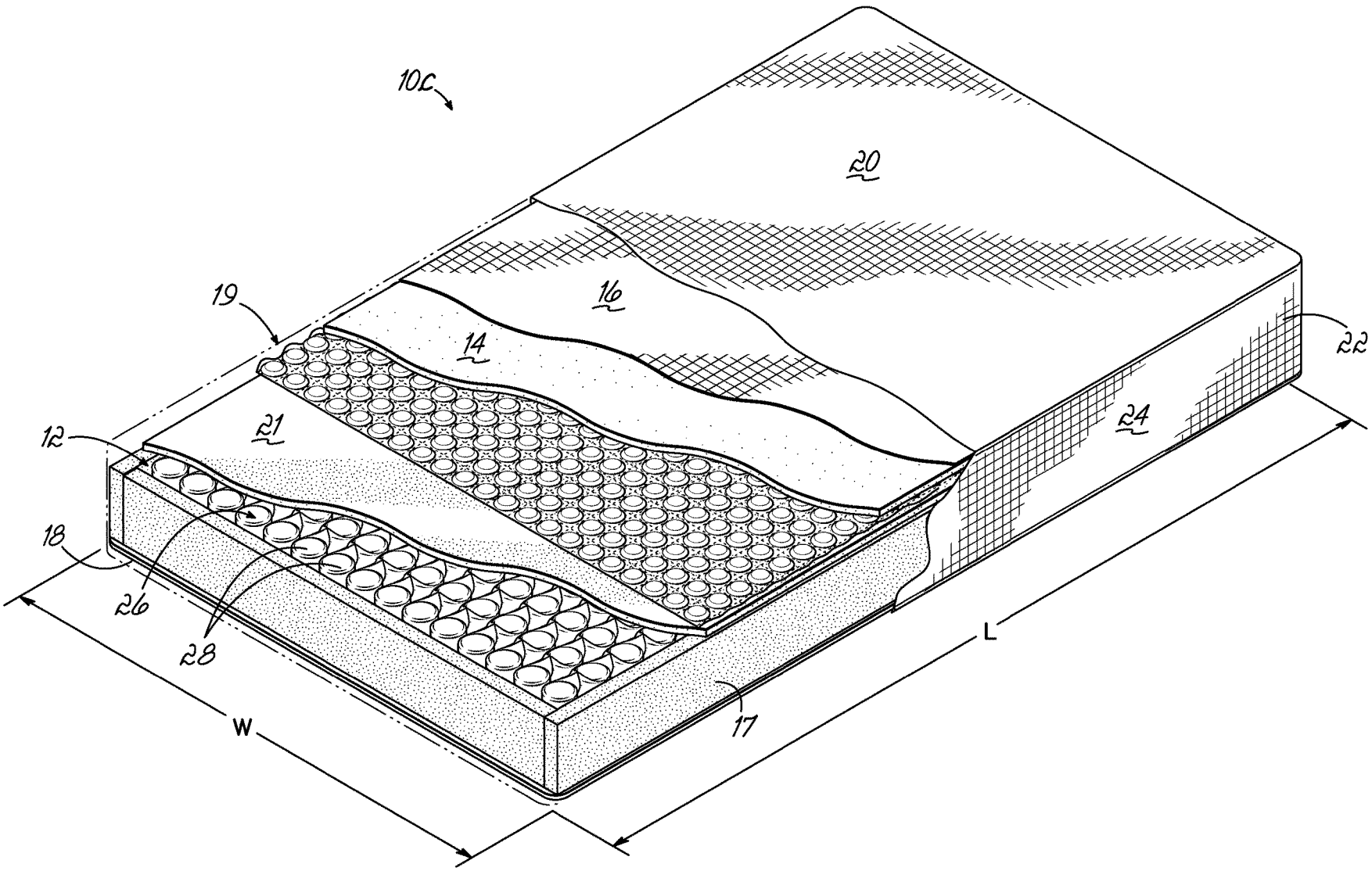
FIG. 1C is a perspective view, partially broken away, of another bedding product incorporating the pocketed spring assembly of FIG. 1.

FIG. 1C illustrates a single-sided mattress 10*c* comprising a pocketed spring assembly 12 and border 17 identical to those shown in the mattress 10 of FIG. 1. However, the mattress 10*c* of FIG. 1C has a pocketed topper 19 comprising miniature pocketed coil springs in addition to padding layers 14, 16 above the pocketed topper 19. A scrim layer 21 separates the pocketed topper 19 from the pocketed spring assembly 12. Although one configuration of pocketed topper 19 is illustrated, any pocketed topper known in the art may be used.

According to this invention, any of the padding or cushioning layers, including the pocketed topper 19, may be omitted in any of the embodiments shown or described herein. The novel features reside in the pocketed spring assembly.

These strings of pocketed springs 26, 26*a* and 26*b*, and any other strings of springs described or shown herein, may be connected in side-by-side relationship as, for example, by gluing the sides of the strings together in an assembly machine, to create an assembly or matrix of springs having multiple rows and columns of pocketed springs bound together as by gluing, welding or any other conventional assembly process commonly used to create pocketed spring cores or assemblies.

Figure 4:
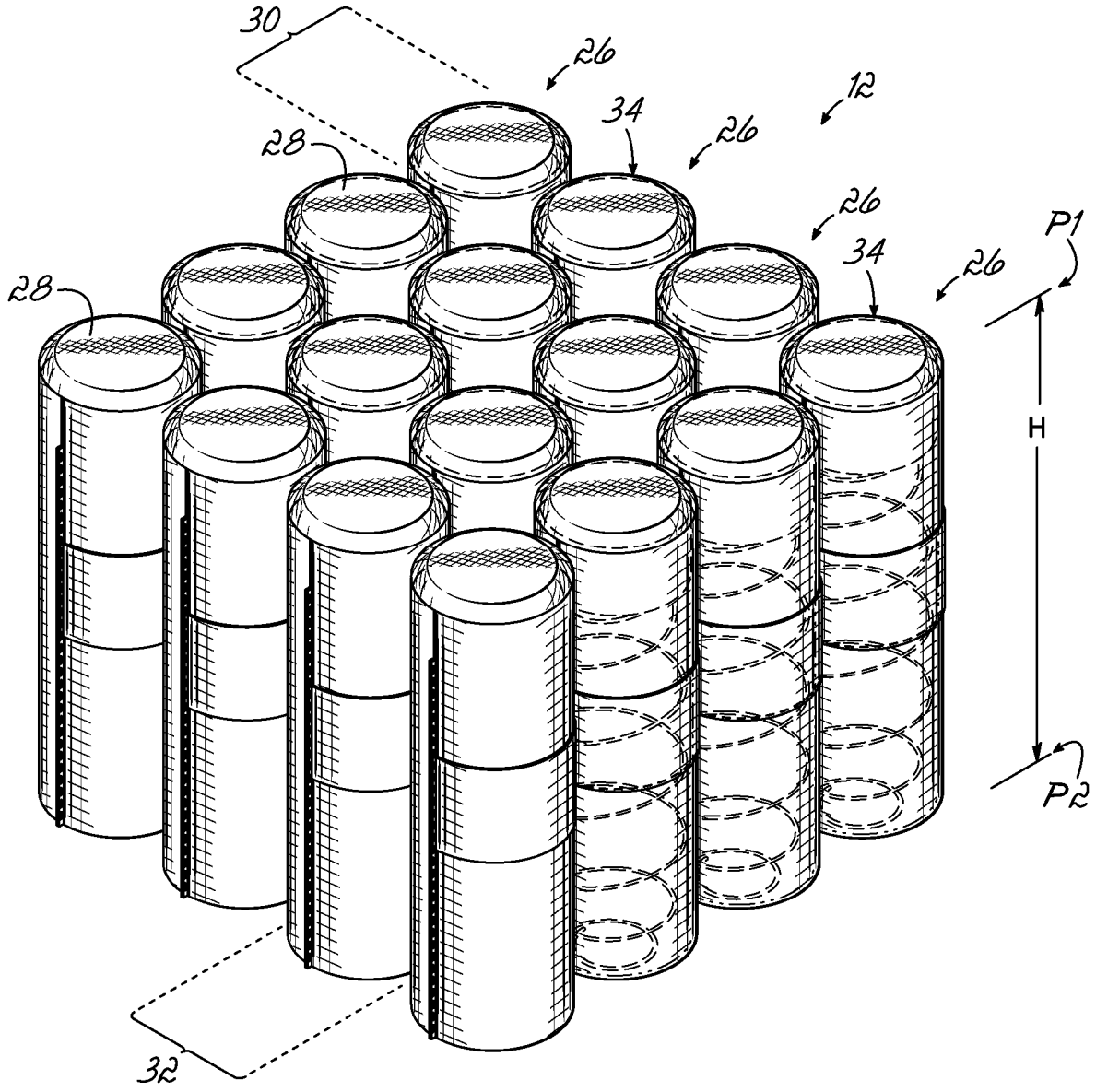
FIG. 4 is a perspective view of a portion of the pocketed spring assembly of FIG. 1 in a relaxed condition.
Figure 5:
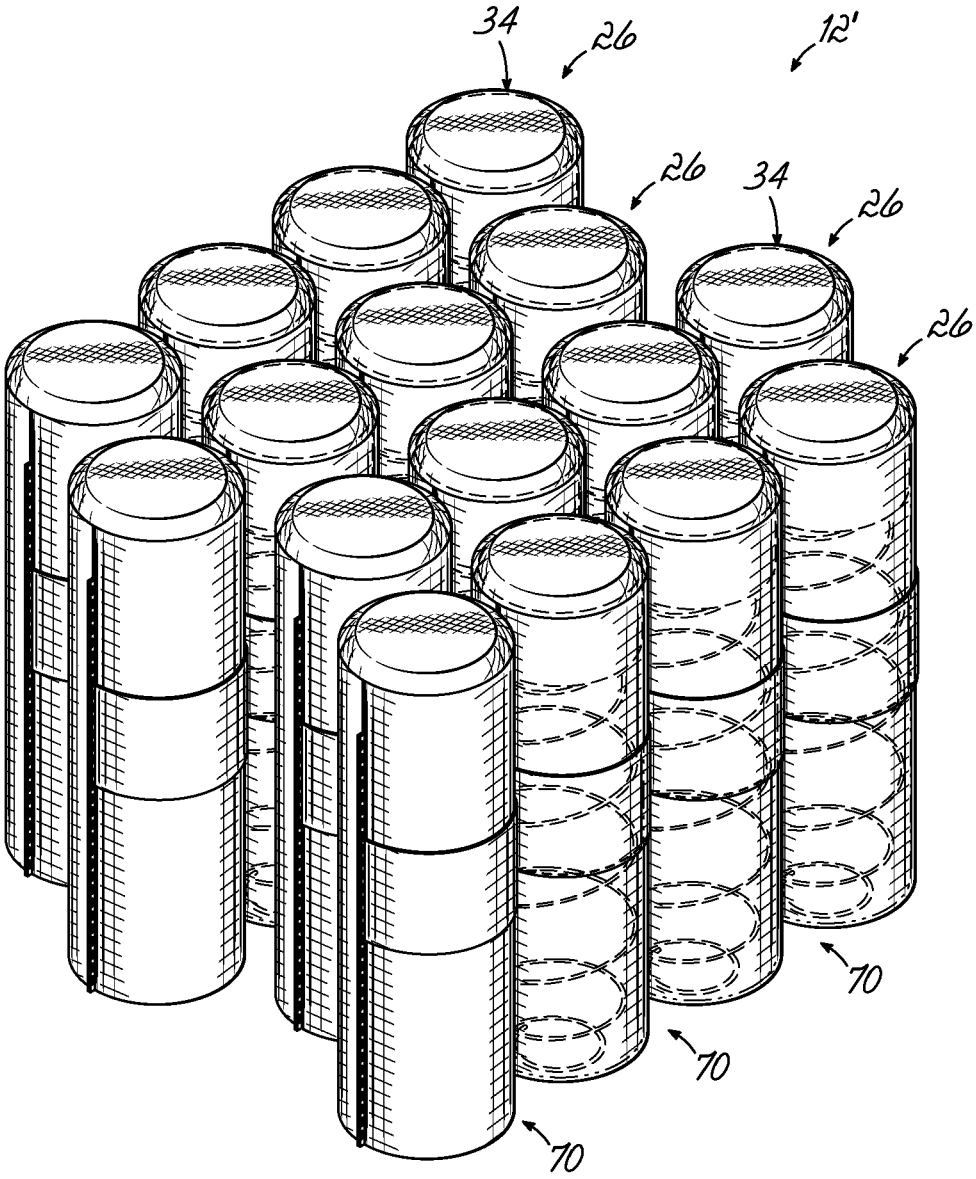
FIG. 5 is a perspective view of a portion of another pocketed spring assembly in a relaxed condition, the strings of springs being offset from one another.

Referring to FIGS. 4 and 5, the strings 26 of pocketed springs may be joined so that the individually pocketed springs 28 are aligned in transversely extending rows 30 and longitudinally extending columns 32. Alternatively, the strings 26 of pocketed springs may be offset from one another in a pocketed spring assembly. In such an arrangement, shown in FIG. 5, the individually pocketed springs 28 are not aligned in rows and columns; instead the individually pocketed springs 28 fill gaps or voids 70 of the adjacent strings 26. FIG. 5 shows a portion of a pocketed spring assembly 12' with multiple strings 26 arranged in this manner. Either alignment of strings may be incorporated into any of the pocketed spring assemblies or cores illustrated or described herein. Although FIGS. 4 and 5 illustrate strings 26, the same alignments may be used in any pocketed spring assembly having strings 26*a* or 26*b*.

Figure 2:
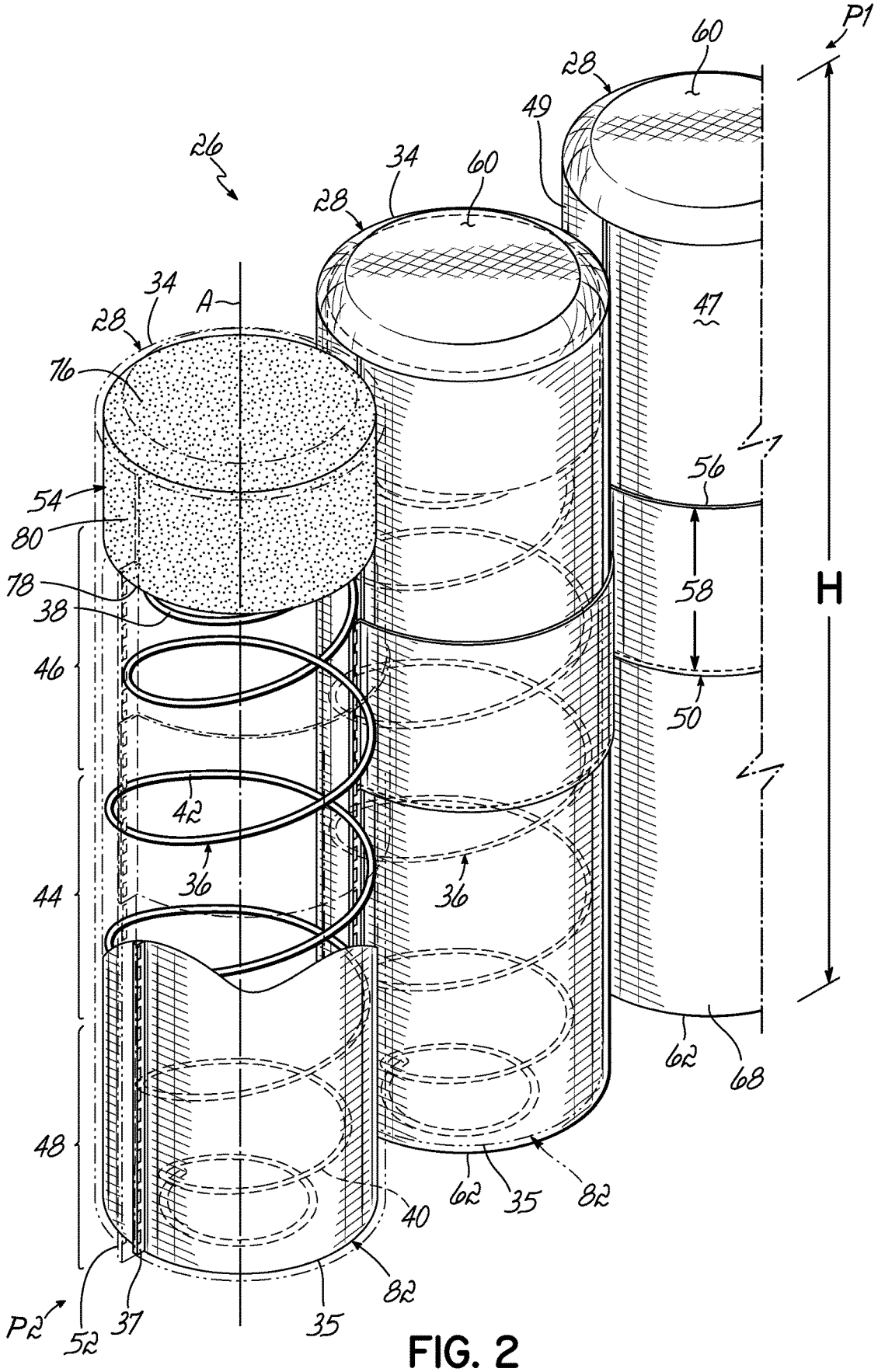
FIG. 2 is a perspective view, partially broken away, of a portion of a string of springs of FIG. 1 in an unloaded condition.
Figure 3A:
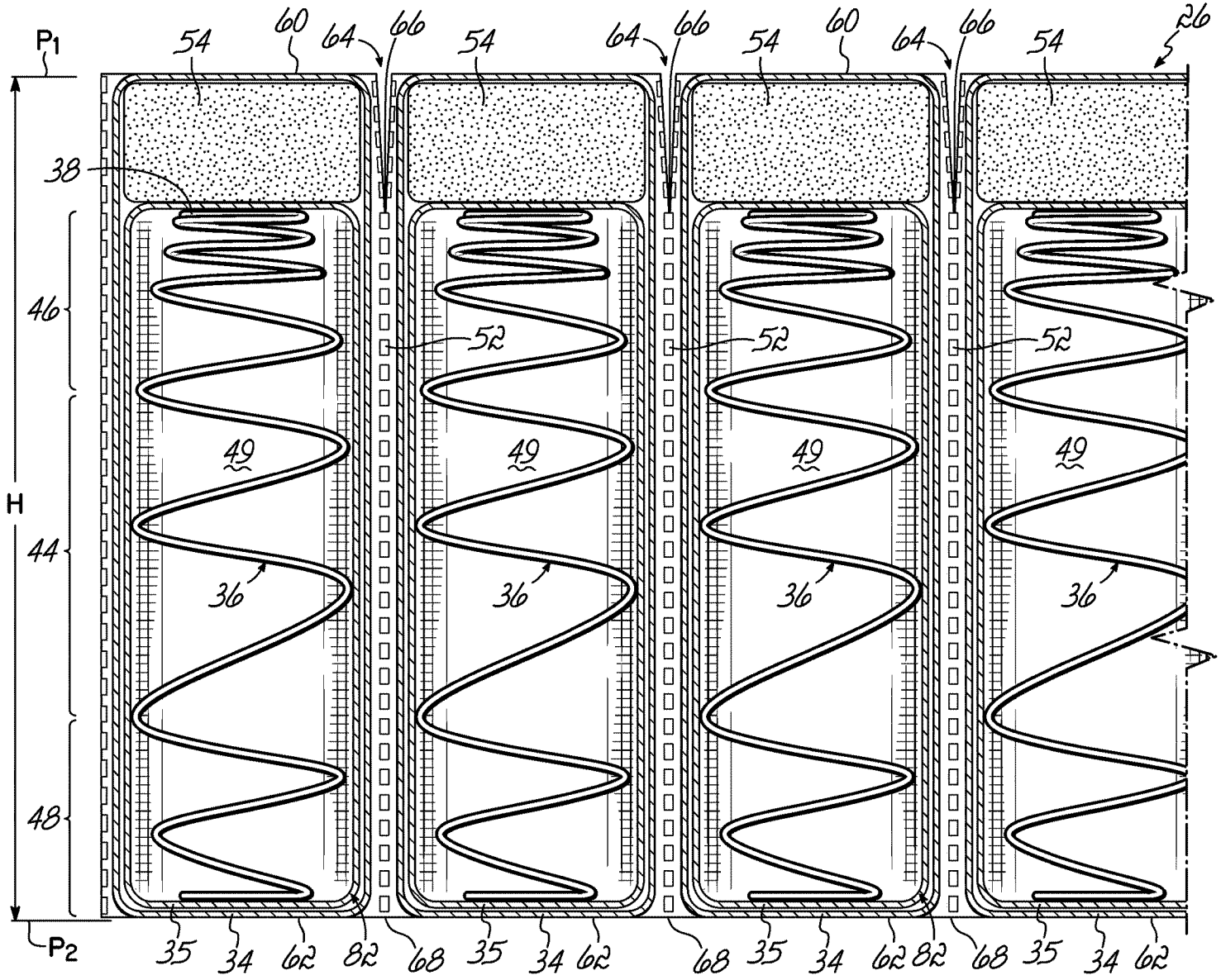
FIG. 3A is a cross-sectional view, partially broken away, of the string of springs of FIG. 2 in an unloaded condition.
Figure 3B:
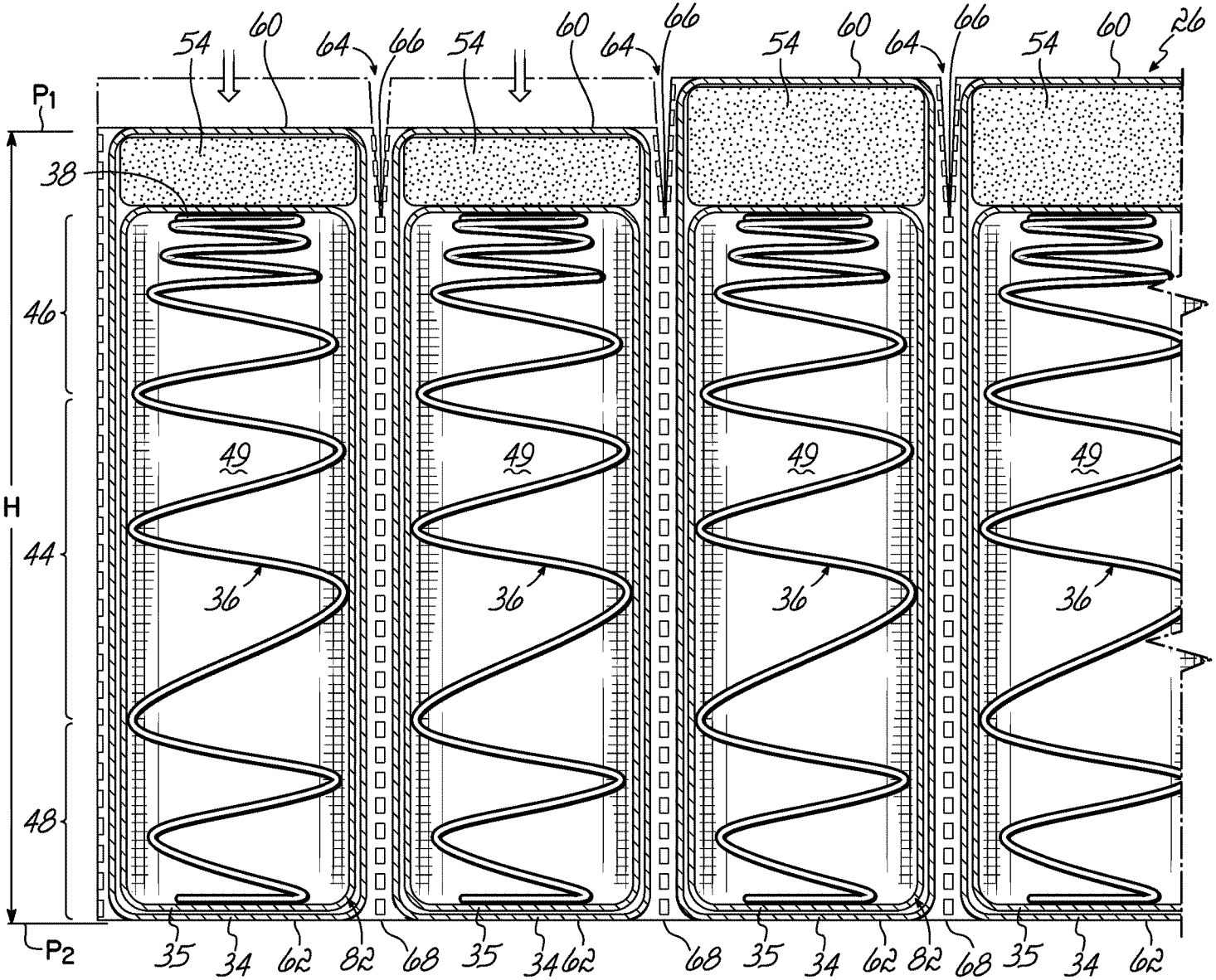
FIG. 3B is a view similar to FIG. 3A, a portion of the string of springs of FIG. 3A being in a loaded condition.

As best illustrated in FIGS. 2, 3A and 3B, each string 26 of pocketed springs 28 comprises a row of interconnected fabric outer pockets 34. Each of the fabric outer pockets 34 contains at least one inner pocketed coil spring 82 and at least one cushion pad 54. Each inner pocketed coil spring 82 comprises a coil spring 36 encased in an inner pocket 35 having two side seams 37. The inner pocket 35 may be made of a single piece of fabric or any number of pieces of fabric.

FIGS. 2, 3A and 3B illustrate a one-sided string 26 for use in a single-sided pocketed spring assembly, such as pocketed spring assembly 12. In string 26, one cushion pad 54 rests on the fabric of the inner pocket 35 above the individually pocketed coil spring 36. In this orientation, the coil spring 36 is prevented from contacting and damaging the material of the cushion pad 54.

For ease of understanding, FIG. 2 illustrates the leftmost outer pocket 34 shown in dashed lines and the inner pocket 35 shown in solid lines. In FIG. 2, the other outer pockets 34 of string 26 are shown in solid lines and the inner pockets 35 shown in dashed lines.

As best shown in FIG. 2, the cushion pad 54 is shown as being shaped like a hockey puck or puck-shaped. Cushion pad 54 is illustrated in FIG. 2 having a circular upper surface 76, a circular lower surface 78 and a sidewall 80.

Figure 2A:
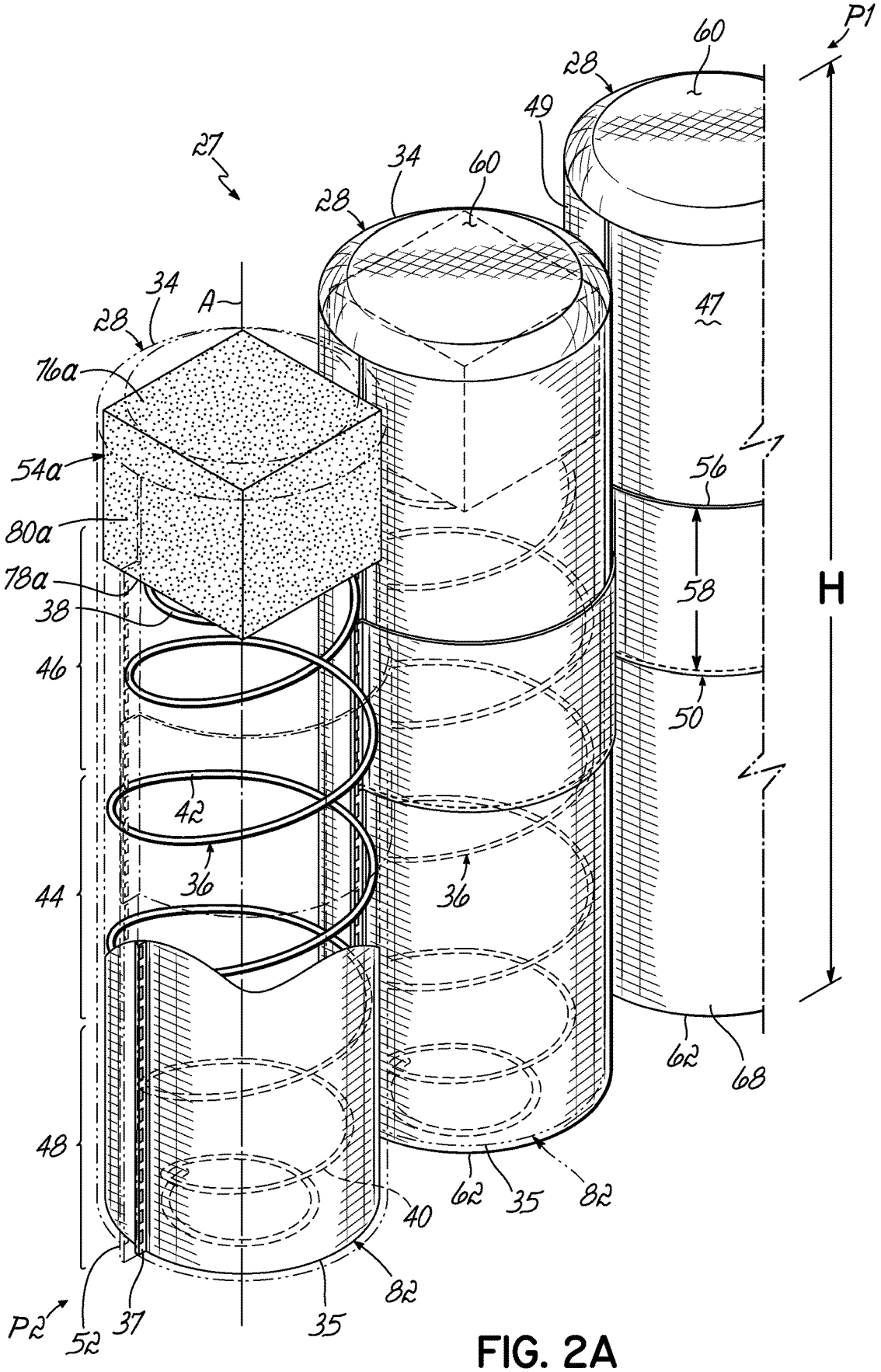
FIG. 2A is a perspective view, partially broken away, of a portion of another string of springs in an unloaded condition.

FIG. 2A illustrates a string 27 identical to string 26, but having a different cushion pad 54*a*. Cushion pad 54*a* has a different shape than cushion pads 54 inside the inner pockets 35 of the string 27. FIG. 2A illustrates a cushion pad 54*a* having a rectangular upper surface 76*a*, a rectangular lower surface 78*a* and four rectangular sidewalls 80*a*. Although FIG. 2A illustrates square upper and lower surfaces and sidewalls, one or more surfaces or sidewalls may be other rectangular shapes. Although FIGS. 2 and 2A illustrate cushion pads 54, 54*a*, respectively, of a certain size and shape, the drawings are not intended to limit the size or shape of the cushion pads.

Each cushion pad 54, 54*a* is illustrated being a single piece of material, such as foam, but may be any number of pieces of any desired material joined together. Alternatively, the cushion pad 54, 54*a* may be made of fiber, cotton, gel or any combination thereof.

The coil spring 36 is preferably made of one piece of wire of a uniform diameter, but may be made of other materials, multiple strands of twisted wire and/or may be a non-uniform diameter. As best shown in FIG. 2, each coil spring 36 has a central or longitudinal axis A, an upper end turn 38, a lower end turn 40 and a plurality of central convolutions 42 between the end turns. FIGS. 2 and 3A illustrate a barrel-shaped coil spring 36 in which the diameter of the end turns 38, 40 is less than the diameter of the central convolutions 42, the central convolutions 42 tapering or decreasing in diameter and pitch as one moves from a center or middle portion 44 of the coil spring towards the end turns. As best shown in FIG. 2, each barrel-shaped coil spring 36 has two end portions which are not identical, an upper end portion 46 and a lower end portion 48. The upper end portion 46 has more convolutions than the lower end portion 48, as best shown in FIGS. 3A and 3B.

Preferably, one piece of fabric is used to create the outer pockets 34 of the string 26 of pocketed springs 36, the piece of fabric being folded over onto itself around the inner pocketed coil springs 82 and the cushion pads 54. As best shown in FIG. 2, opposite sides or plies 47, 49 of the fabric are sewn, welded or otherwise secured together to create a longitudinal seam 50 and a plurality of separating or transverse seams 52. FIG. 2 illustrates ply 47 being closest to the reader and ply 49 being behind the springs 36.

Although the seams or welds in the embodiments shown herein are shown as being welded spaced rectangles, any of the seams may be spaced dots, triangles or solid line segments without spaces.

As best shown in FIG. 2, opposed edges 56 of the piece of fabric used to create the string of pocketed springs 26 are aligned and spaced from the longitudinal seam 50 a distance indicated by numeral 58. Although the drawings indicated the longitudinal seam 50 being below the free edges 56 of the piece of fabric, the longitudinal seam 50 may be above the free edges 56 of the piece of fabric.

As shown in FIGS. 2 and 3A, the string of pocketed springs 26 has a generally planar top surface 60 in a top plane P1 and a parallel generally planar bottom surface 62 in a bottom plane P2. The linear distance between the top and bottom surfaces 60, 62 of the string 26 defines a height H of the string 26. This linear distance further defines the height H of the pocketed spring assembly 12 because each of the strings 26 has the same height. However, it is within the scope of the present invention that different strings of springs of a pocketed spring assembly have different heights.

In accordance with one embodiment, in strings 26, the transverse seams 52 forming the adjacent outer pockets 34 are divided as at 64 to thereby form a cut, slit, or notch by, for example, cutting, slitting, severing, melting, or the like, from the upper surface 60 of the string 26 inwardly (downwardly as illustrated), to partially separate the adjacent outer pockets 34. Preferably, the divide 64 extends to beyond or below the cushion pad 54, but may be any desired length including less than the height of the cushion pad 54. As best shown in FIGS. 2 and 3A, the transverse seams 52 of the strings 26 each have an upper end 66 located at the bottom of each divide 64 and a lower end 68. As shown in FIG. 3A, the upper end 66 of each transverse seam 52 is located below adjacent cushion pads 54 when the coil springs 36 are in a relaxed condition and not loaded.

The significance of divide 64 may be appreciated with reference to FIG. 3B. Divide 64 essentially decouples each cushion pad 54 from its adjacent cushion pad 54 during initial deflection of cushion pad 54. This creates more of an individual coil performance and allows the inner pocketed coil spring 82 to engage a person sleeping on the mattress 10 sooner while giving the person a softer feel at the beginning of the coil deflections. It is believed that this arrangement provides a more comfortable pocketed spring assembly 12.

Figure 6:
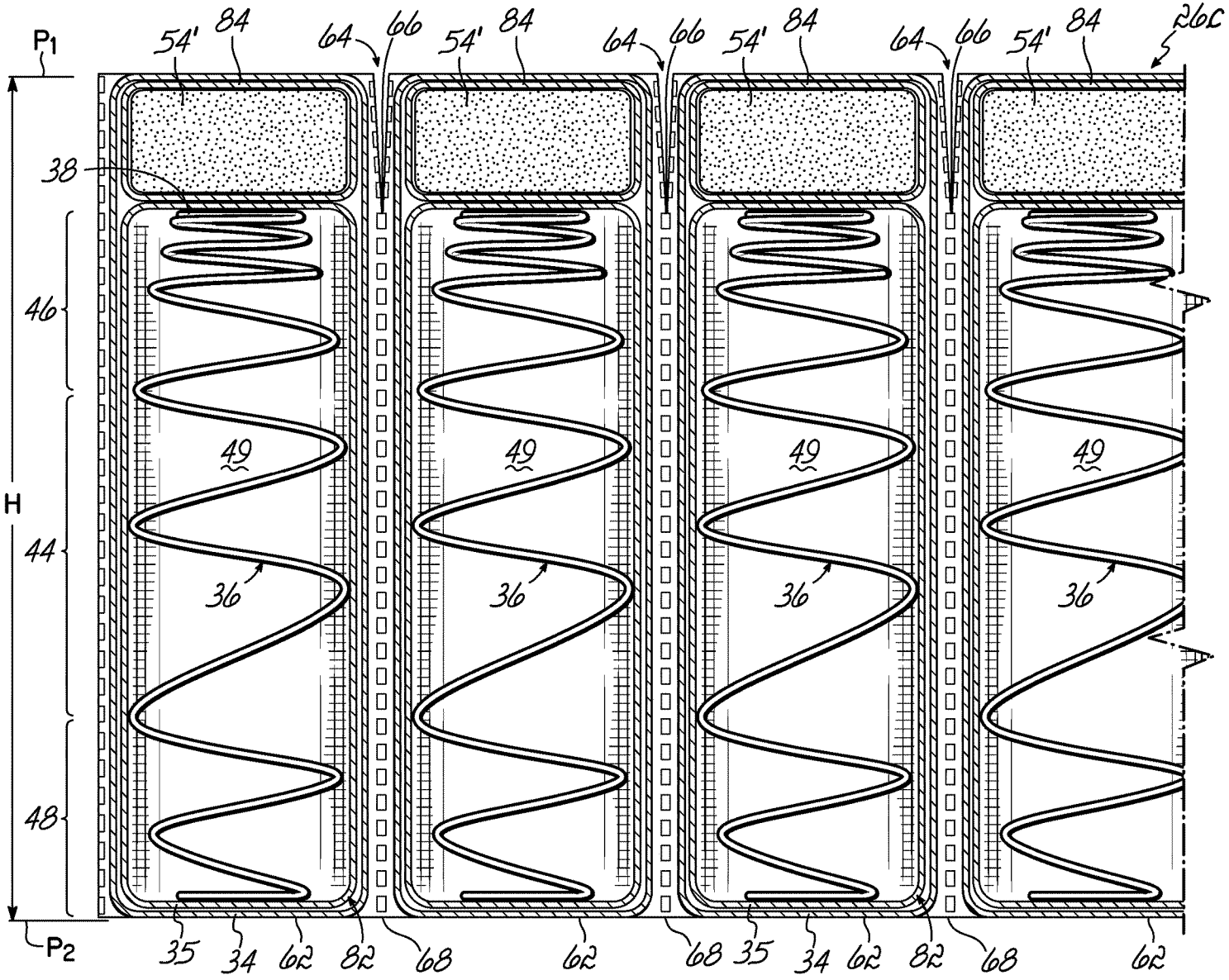
FIG. 6 is a cross-sectional view, partially broken away, of another string of springs in an unloaded condition.

FIG. 6 illustrates another embodiment of string 26*c* which may be used in any of the pocketed spring assemblies or products shown or described herein. The string 26*c* comprises the same seams, same inner pocketed springs 82 and outer fabric pockets 34 as incorporated into strings 26. However, each cushion pad 54' comprises a cushion pad 54 encased in a fabric cover 84. Each cushion pad 54' has its own fabric cover 84 which prevents the coil spring 36 of the inner pocketed coil spring 82 from contacting and damaging the cushion pad or pads over time, in addition to the inner pocket 35 of fabric of the inner pocketed coil spring 82.

Figure 7:
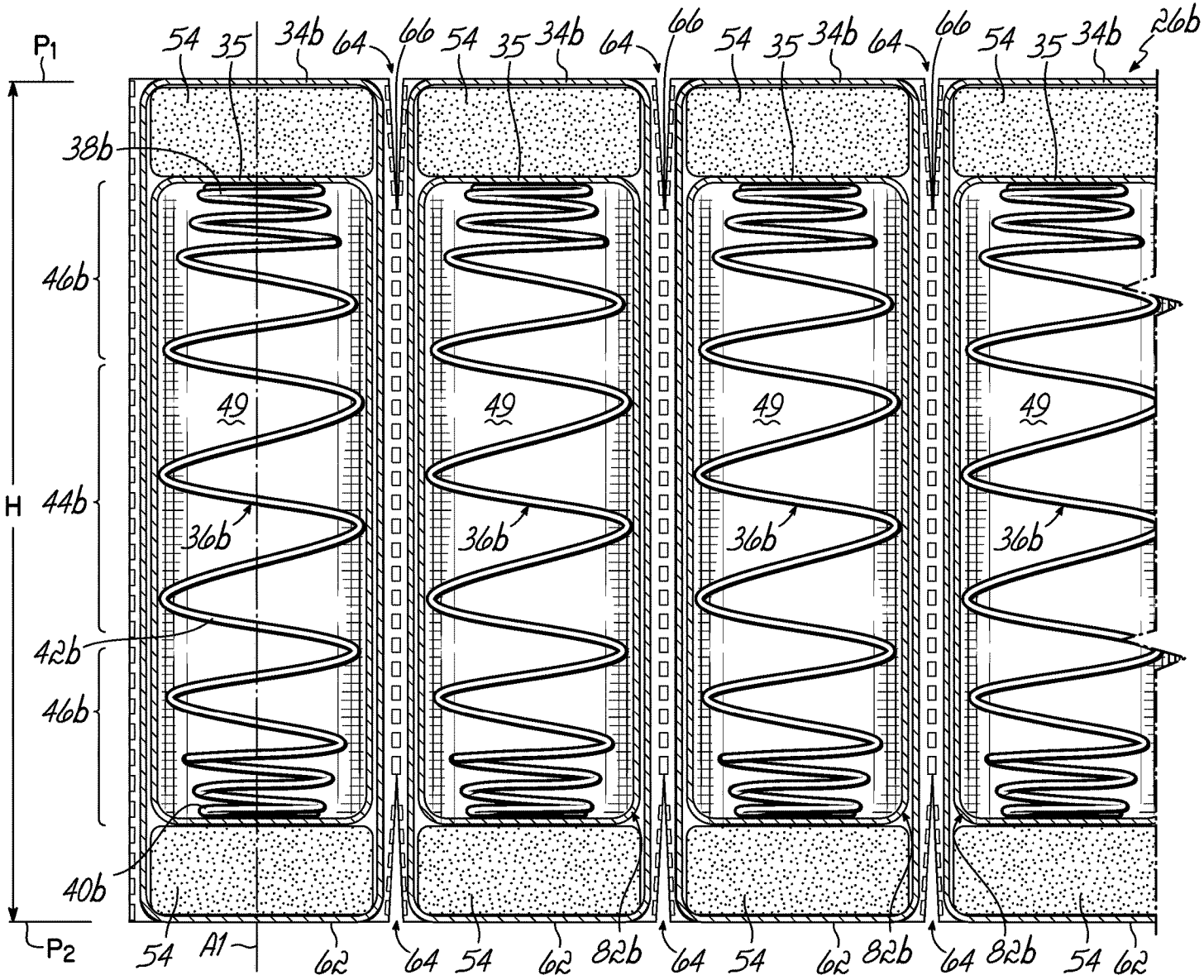
FIG. 7 is a cross-sectional view, partially broken away, of double-sided string of springs in an unloaded condition.

Referring now to FIGS. 1B and 7, while the mattresses 10 illustrated in FIGS. 1, 1A and 1C are single-sided mattresses, any other pocketed spring assembly shown or described herein, may be incorporated into any bedding or seating product, including a double-sided mattress or seating cushion.

FIG. 7 illustrates a portion of a string of springs 26*b* used in a double-sided pocketed spring assembly, like pocketed spring assembly 12*b* shown in FIG. 1B. The fabric outer pockets 34*b* of such strings 26*b* are slightly different than the fabric outer pockets 34 of string of springs 26. There are divides 64 along the tops and bottoms of the strings 26*b*.

FIG. 7 illustrates a two-sided string 26*b* for use in a double-sided pocketed spring assembly 12*b*, as shown in FIG. 1B. Two cushion pads 54 are located inside each outer pocket 34*b* along with an inner pocketed spring 82 located between the cushion pads 54. One of the cushion pads 54 is located above the inner pocketed coil spring 82*b* and the other cushion pad 54 is located below the inner pocketed coil spring 82*b*. Although FIG. 7 illustrates cushion pads 54 lacking covers, encased cushion pads 54' or cushion pads of different shapes, such as shown in FIG. 2A, may be used in the double-sided string 26*b* or any string shown or described herein.

Additionally, the coil springs 36*b* of inner pocketed springs 82*b* are different than the coil springs 36 of inner pocketed springs 82 shown in FIGS. 3A and 3B. Each coil spring 36*b* comprises a central or longitudinal axis A1, an upper end turn 38*b*, a lower end turn 40*b* and a plurality of central convolutions 42*b* between the end turns. FIGS. 1B and 7 illustrate a barrel-shaped coil spring 36*b* in which the diameter of the end turns 38*b*, 40*b* is less than the diameter of the central convolutions 42*b*, the central convolutions 42*b* tapering or decreasing in diameter and pitch as one moves from a center or middle portion 44*b* of the coil spring towards the end turns. As best shown in FIG. 7, each barrel-shaped coil spring 36*b* has two identical end portions 46*b*.

Figure 8:
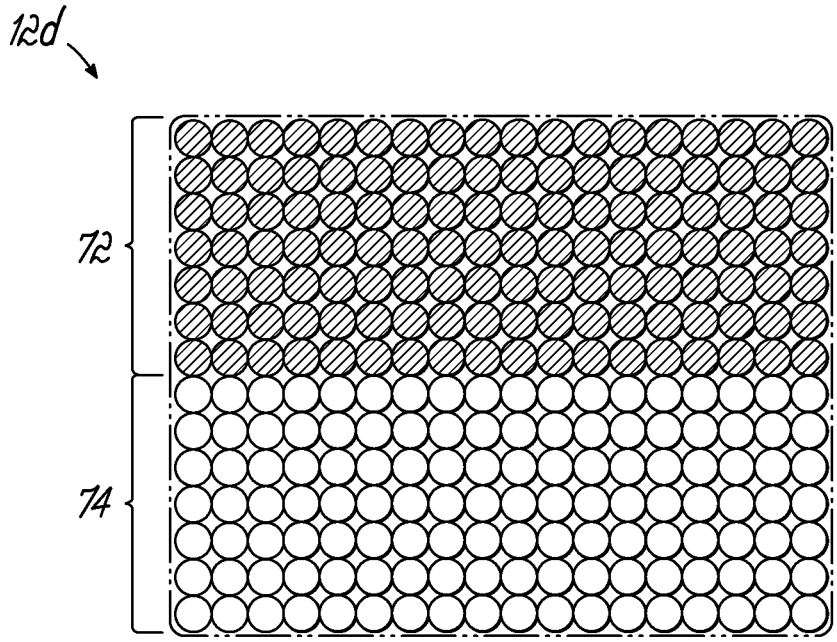
FIG. 8 is a top view of a posturized pocketed spring assembly.

Referring now to FIG. 8, longitudinally extending strings are shown in one preferable arrangement for a spring core for a bedding or seating product, such as a mattress. As can be seen, the longitudinally extending strings are arranged in a plurality of zones on the pocketed spring assembly 12*d*. By way of example, two zones 72, 74 are illustrated, with the zones corresponding roughly to a "firm" side and a "soft" side. By way of further example, the longitudinally extending strings of the "soft" zone 72 each have the split top feature shown and described herein. The longitudinally extending strings of the "firm" zone 74 are strings lacking any split top feature. Of course, other arrangements are within the scope of the invention. For example, the pocketed spring assembly 12*d* shown in FIG. 8 may comprise transversely extending strings rather than longitudinally extending strings. In such an arrangement, each transversely extending string would have to be half firm and half soft. Therefore, each string would have only half the string having the split top feature, the other half lacking such feature.

Figure 9:
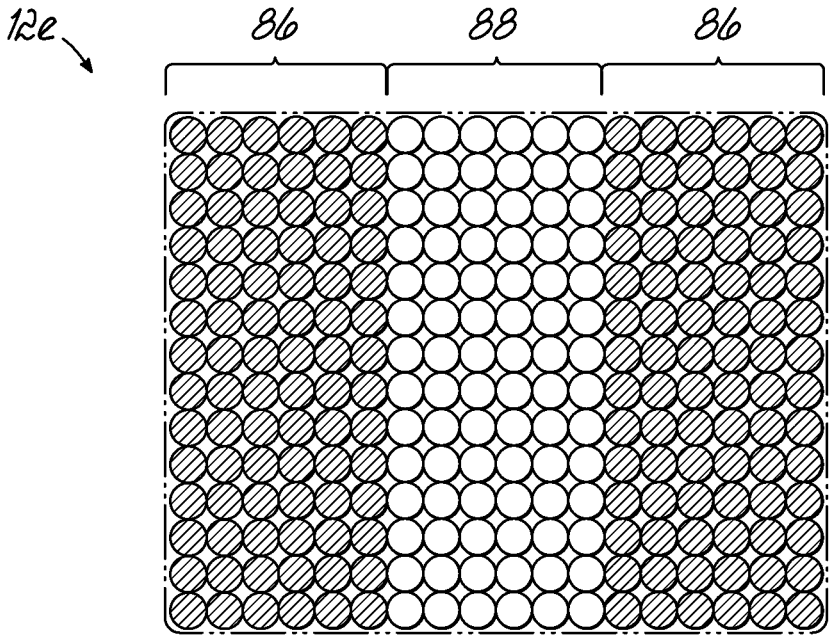
FIG. 9 is a top view of another posturized pocketed spring assembly.

Referring now to FIG. 9, the transversely extending strings are shown in one preferable arrangement for a pocketed spring assembly 12*e* for a bedding or seating product, such as a mattress. As can be seen, the transversely extending strings are arranged in a plurality of zones on the pocketed spring assembly 12*e*. By way of example, three zones are illustrated, with the zones corresponding roughly to the location of a sleeper's head and shoulders, mid-section, knees and feet. By way of further example, the two end "soft" zones 86 each comprise strings of springs having the split top feature shown and described herein. The transversely extending strings of the middle or "firm" zone 88 are strings lacking any split top feature. Of course, other arrangements are within the scope of the invention. For example, the mattress shown in FIG. 9 may comprise longitudinally extending strings rather than transversely extending strings. In such an arrangement, each longitudinally extending string would have to be divided into three sections; a middle "firm" section and two end or "soft" sections. Therefore, each string would have only the end thirds of the string having the split top feature, the middle third lacking such feature.

Figure 3D:
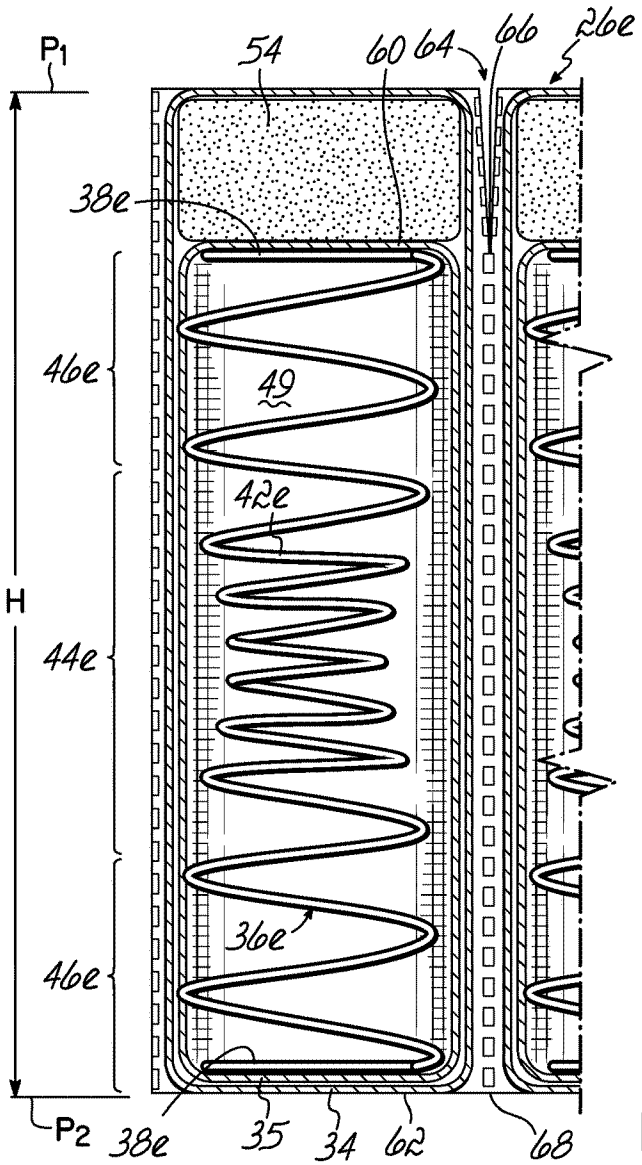
FIG. 3D is a cross-sectional view, partially broken away, of a string of springs having a different spring in an unloaded condition.
Figure 3C:
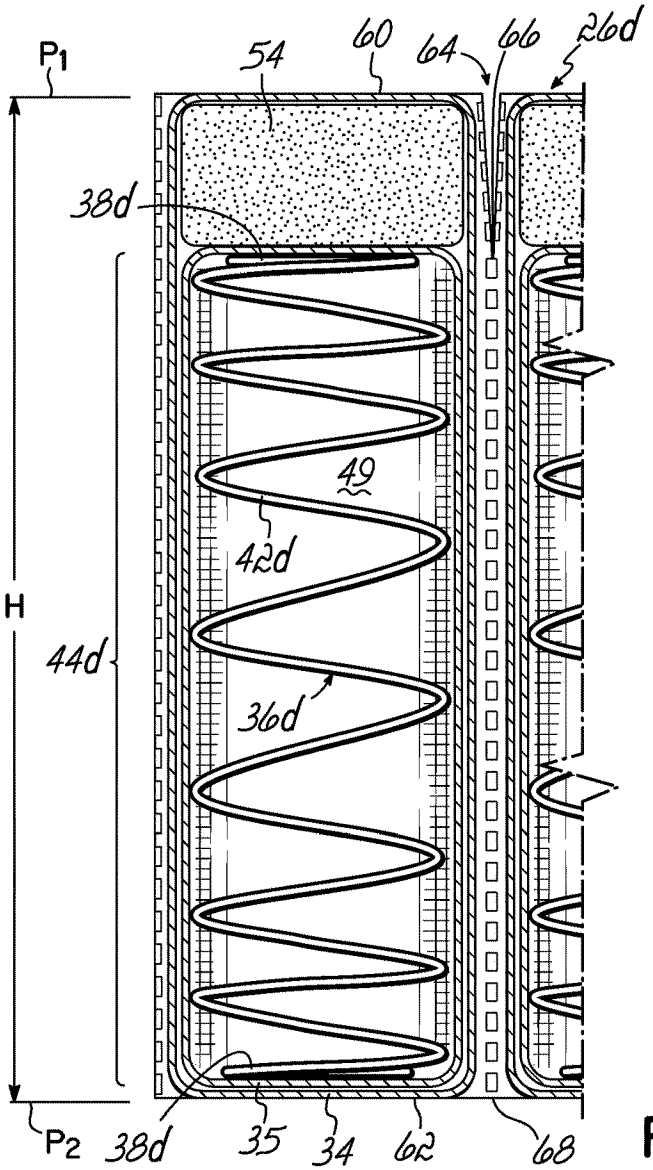
FIG. 3C is a cross-sectional view, partially broken away, of a string of springs having a different spring in an unloaded condition.

FIGS. 3C and 3D illustrate portions of other embodiments of strings 26*d*, 26*e*, respectively, which may be incorporated into any of the products shown or described herein. The strings 26*d*, 26*e* each comprise the same seams and outer pockets 34 as incorporated into strings 26. However, the springs 36*d*, 36*e* within the strings 26*d*, 26*e*, respectively are different than the springs 36 of strings 26. Although springs 36*d*, 36*e* are only shown in FIGS. 3C and 3D, they may be used in any string shown or described herein, including two-sided strings having cushion pads above and below each coil spring.

As shown in FIG. 3C, coil springs 36*d* (only one being shown) each have identical end turns 38*d* of a smaller diameter than the central convolutions 42*d* therebetween in a central portion 44*d* thereof. The central convolutions 42*d* of coil springs 36*d* are identical having the same diameter greater than the diameter of end turns 38*d*.

As shown in FIG. 3D, coil springs 36*e* (only one being shown) each have two identical end portions 46*e* and a central portion 44*e* therebetween. The central portion 44*e* has more convolutions than each end portion 46*e*, as shown in FIG. 3D. Each coil spring 36*e* has identical end turns 38*e* of a larger diameter than the central convolutions 42*e* therebetween of the central portion 44*e*. The central convolutions 42*e* of coil springs 36*e* have the same diameter, which is greater than the diameter of end turns 38*e*.

Figure 10:
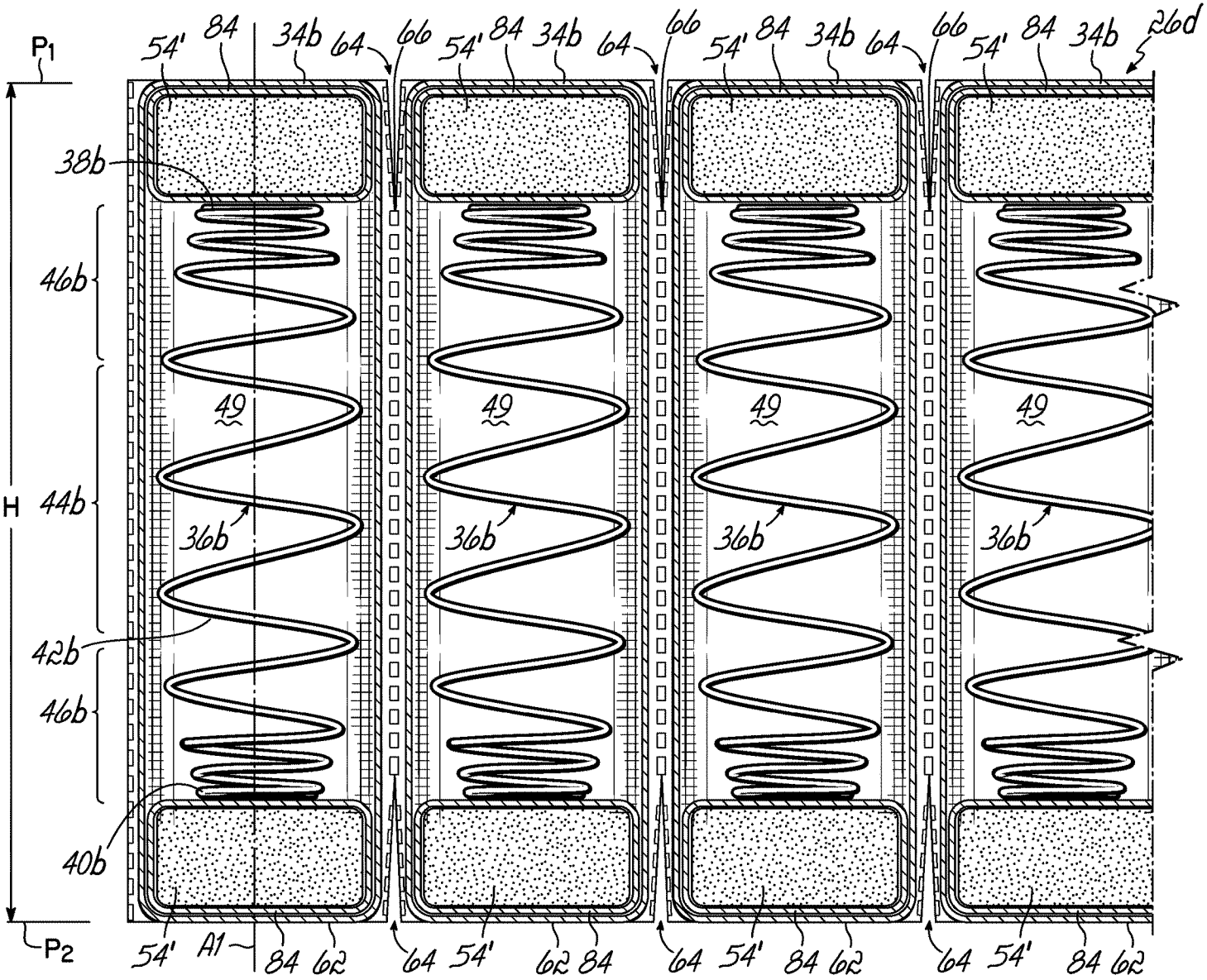
FIG. 10 is a cross-sectional view, partially broken away, of another string of springs in an unloaded condition.

FIG. 10 illustrates another embodiment of string 26*d* which may be used in any of the pocketed spring assemblies or products shown or described herein. The double-sided string 26*d* comprises the same seams, same coil springs 36*b* and outer fabric pockets 34*b* as incorporated into strings 26*b* shown in FIG. 7. However, each coil spring 36 lacks an inner pocket but is surrounded by the fabric of the outer pocket, along with one or more individually pocketed cushion pads 54'.

Like the cushion pads 54' shown in FIG. 6, each cushion pad 54' comprises a cushion pad 54' encased in a fabric cover 84. Each cushion pad 54' has its own fabric cover 84 which prevents the coil spring 36*b* from contacting and damaging the cushion pad or pads over time.

Although the string 26*d* is shown as a double-sided string, the concept illustrated therein of combining an un-pocketed coil spring with pocketed cushion pads may be incorporated into any of the strings or pocketed spring assemblies shown or described herein, including single sided strings and single-sided pocketed spring assemblies. Any of the coil springs shown or described herein may be used in a version in which only the cushion pad or pads is pocketed and the coil spring has no inner pocket, just an outer pocket.

Figure 11:
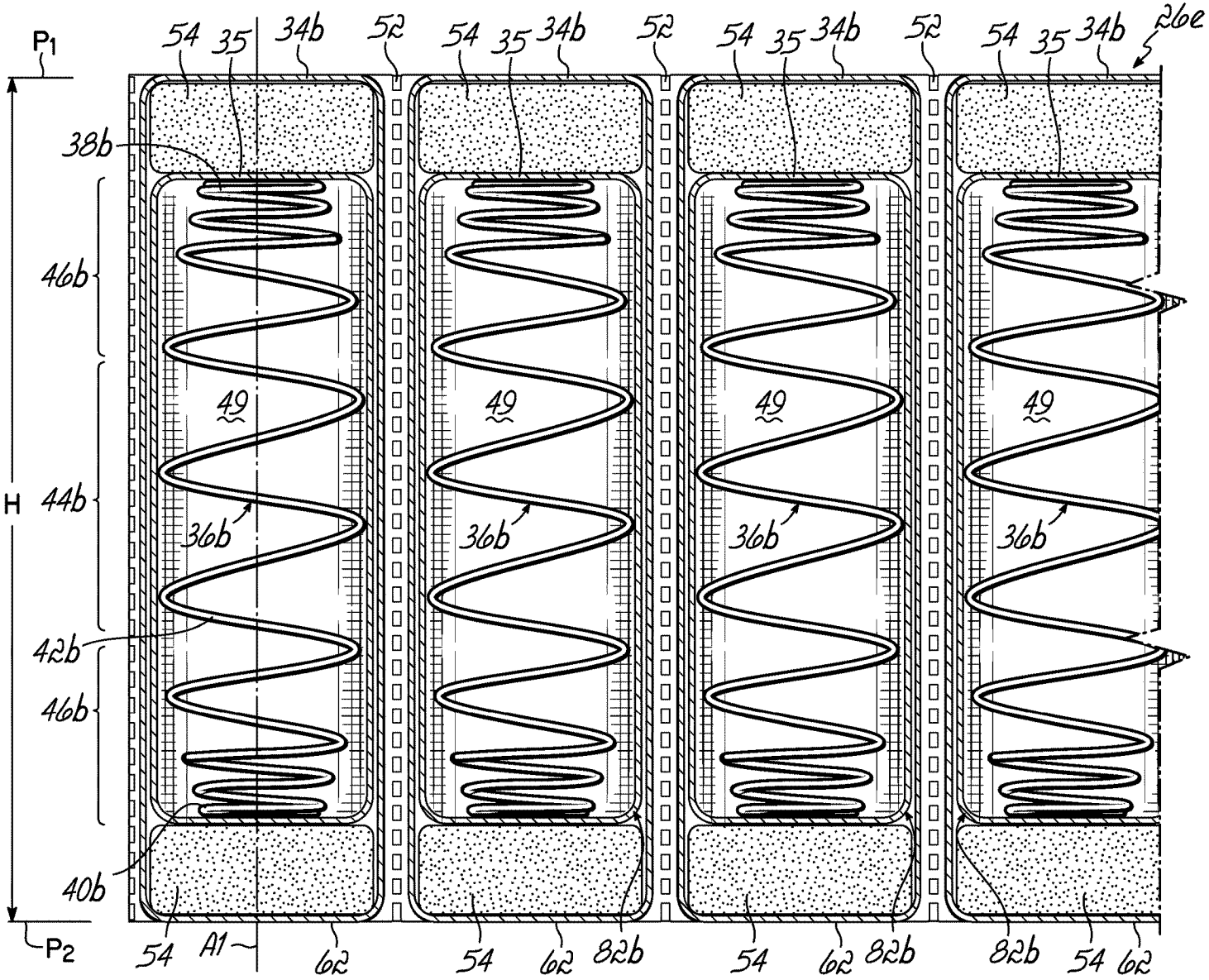
FIG. 11 is a cross-sectional view, partially broken away, of another string of springs in an unloaded condition.

FIG. 11 illustrates another embodiment of string 26*e* which may be used in any of the pocketed spring assemblies or products shown or described herein. The double-sided string 26*e* comprises the same seams, same inner pocketed springs 82*b* including same coil springs 36*b*, same cushion pads 54 and same outer fabric pockets 34*b* as incorporated into strings 26*b* shown in FIG. 7. However, each string 26*e* lacks divides 64 or "split top" feature. Any of the embodiments of strings or pocketed spring assemblies shown or described herein may lack the divides or "split top" feature regardless of the whether one-sided or double-sided.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. For example, more than two cushion pads or more than one inner pocketed spring may be inside an outer pocket. The invention resides in each individual feature described herein, alone, and in all combinations of any and all of those features. Accordingly, the scope of the invention shall be limited only by the following claims and their equivalents.

What is claimed is:

1. A bedding or seating product comprising:

a pocketed spring assembly comprising a plurality of parallel strings of springs, each of said strings being joined to at least one adjacent string, each of said strings comprising a piece of fabric surrounding a plurality of pocketed springs and a plurality of cushion pads, first and second opposed plies of fabric being on opposite sides of the pocketed springs and cushion pads, a plurality of outer pockets formed along said string by a longitudinal seam and transverse seams joining said first and second plies, at least one pocketed spring and at least one cushion pad being in each of said outer pockets;

cushioning materials; and a covering encasing said pocketed spring assembly and cushioning materials.

2. A bedding or seating product comprising:

a pocketed spring assembly comprising a plurality of parallel strings of springs, each of said strings being joined to at least one adjacent string, each of said strings comprising a piece of fabric surrounding a plurality of pocketed springs and a plurality of cushion pads, first and second opposed plies of fabric being on opposite sides of the pocketed springs and cushion pads, a plurality of outer pockets formed along said string by a longitudinal seam and transverse seams joining said first and second plies, at least one pocketed spring and at least one cushion pad being in each of said outer pockets.

3. The product of claim 2, wherein each of the cushion pads is individually pocketed.

4. The product of claim 2, wherein an upper end of each of said transverse seams is below an upper surface of the string to partially separate adjacent outer pockets.

5. The product of claim 2, wherein said longitudinal seam is a side seam.

6. The product of claim 2, wherein two cushion pads are in each of said outer pockets.

7. The product of claim 2, wherein each of the springs has a central portion of a uniform diameter.

8. A pocketed spring assembly for a bedding or seating product, said pocketed spring assembly comprising:

a plurality of parallel strings of springs, each of the strings being joined to at least one adjacent string, each of the strings comprising a plurality of interconnected outer pockets made from one piece of fabric, each of the outer pockets containing at least one inner pocketed spring and at least one cushion pad, the piece of fabric being joined to itself along a longitudinal seam and having first and second opposed plies of fabric on opposite sides of the springs, the first and second plies being joined by transverse seams between adjacent inner pocketed springs.

9. The pocketed spring assembly of claim 8, wherein two cushion pads are in each of said outer pockets.

10. The pocketed spring assembly of claim 9, wherein said at least one inner pocketed spring is between the cushion pads.

11. The pocketed spring assembly of claim 8, wherein each of said transverse seams forming adjacent outer pockets of said string has one end located below an upper surface of said string to partially separate adjacent outer pockets.

12. The pocketed spring assembly of claim 11, wherein the inner pocketed springs are below the upper end of adjacent transverse seams.

13. The pocketed spring assembly of claim 8, wherein each of said cushion pads is made at least partially of foam.

14. The pocketed spring assembly of claim 8, wherein each of the cushion pads is individually pocketed.

15. A pocketed spring assembly for a bedding or seating product, said pocketed spring assembly comprising:

a plurality of parallel strings of springs, each of the strings being joined to an adjacent string, each of the strings comprising a plurality of interconnected outer pockets made from one piece of fabric, each of the outer pockets containing one inner pocketed spring and at least one cushion pad, the piece of fabric being joined to itself along a longitudinal seam and having first and second opposed plies of fabric on opposite sides of the inner pocketed springs, the fabric of said first and second plies being joined by transverse seams, each of the transverse seams being shorter than the string, wherein each of said transverse seams forming adjacent pockets of said string has an upper end located below an upper surface of said string to partially separate said adjacent outer pockets and enable some of the cushion pads to compress without substantially compressing other cushion pads within other outer pockets.

16. The pocketed spring assembly of claim 15, wherein the upper end turn and multiple convolutions of each of said springs are above the upper end of adjacent transverse seams.

17. The pocketed spring assembly of claim 15, wherein said strings of springs extend longitudinally.

18. The pocketed spring assembly of claim 15, wherein said strings of springs extend transversely.

19. The pocketed spring assembly of claim 15, wherein the longitudinal seam of each of said strings is located along a side of the string.

20. The pocketed spring assembly of claim 15, wherein one of the end portions of the spring has more convolutions than the other end portion of the spring.

* * * * *